US009540721B2

(12) United States Patent
Barbour

(10) Patent No.: US 9,540,721 B2
(45) Date of Patent: Jan. 10, 2017

(54) METHOD OF CARBURIZING

(71) Applicant: George E. Barbour, Pittsford, MI (US)

(72) Inventor: George E. Barbour, Pittsford, MI (US)

(73) Assignee: George E. Barbour, Pittsford, MI (US)

( * ) Notice: Subject to any disclaimer, the term of this patent is extended or adjusted under 35 U.S.C. 154(b) by 385 days.

(21) Appl. No.: 14/301,977

(22) Filed: Jun. 11, 2014

(65) Prior Publication Data

US 2014/0366993 A1 Dec. 18, 2014

Related U.S. Application Data

(60) Provisional application No. 61/834,060, filed on Jun. 12, 2013.

(51) Int. Cl.

| | |
|---|---|
| ***C23C 8/22*** | (2006.01) |
| ***C21D 1/74*** | (2006.01) |
| ***C21D 1/76*** | (2006.01) |
| ***C21D 1/06*** | (2006.01) |
| ***C21D 1/40*** | (2006.01) |
| *F27D 7/06* | (2006.01) |

(52) U.S. Cl.

CPC . *C23C 8/22* (2013.01); *C21D 1/06* (2013.01); *C21D 1/40* (2013.01); *C21D 1/74* (2013.01); *C21D 1/76* (2013.01); *F27D 2007/063* (2013.01)

(58) Field of Classification Search

CPC ..... C23C 8/22; C21D 1/74; C21D 1/76; C21D 1/06; C21D 1/40; F27D 2007/063

See application file for complete search history.

(56) References Cited

U.S. PATENT DOCUMENTS

| | | | | |
|---|---|---|---|---|
| 4,049,472 A | | 9/1977 | Arndt | |
| 4,807,853 A | * | 2/1989 | Murakami | C21D 1/773 266/250 |
| 6,051,078 A | | 4/2000 | Naito et al. | |
| 6,159,306 A | | 12/2000 | Barbour | |

* cited by examiner

*Primary Examiner* — Jessee Roe

(74) *Attorney, Agent, or Firm* — Rankin, Hill & Clark LLP

(57) ABSTRACT

A method of carburizing ferrous metal parts that includes the steps of providing a furnace for heating the metal parts and a process chamber, purging the air atmosphere from the process chamber and heating said process chamber to a temperature of at least 1100° F., feeding a gas to the process chamber and a source of air at a constant flow rate to the process chamber, boosting the process chamber by feeding an enriching gas to the process chamber to create a carbon potential of at least 0.5%, and more preferably of at least 1.4%, cleaning the process chamber by decreasing the flow of enriching gas to the process chamber to create a carbon potential of less than about 0.25%, repeating the boosting step after performing said cleaning step, and repeating the cleaning step after performing said boosting step.

27 Claims, 5 Drawing Sheets

METHOD OF CARBURIZING

BACKGROUND OF INVENTION

Field of Invention

The invention concerns the field of metallurgical heat treating. More particularly, the invention concerns processes for carburizing ferrous metal parts under a controlled atmosphere at elevated temperatures. These processes are commonly referred to as gas carburizing.

Description of Related Art

Carburization is the conventional process for the case hardening of steel. In gas carburizing, the steel is exposed to an atmosphere which contains components capable of transferring carbon to the surface of the metal from which it diffuses into the body of the part. In many carburizing processes, an important constituent of the furnace atmosphere used to carburize metal parts is the carrier gas. A carrier gas serves to provide a furnace with a positive protective atmosphere wherein an enriching gas may be dispersed.

A variety of carrier gases have been employed in carburizing as discussed in U.S. Pat. No. 4,049,472, but the most common carrier gas is the endothermic (endo) gas derived by partial combustion of natural gas in air. When using endothermic gas, it is usually necessary to add a relatively small quantity of another constituent (i.e., enriching gas), usually natural gas, to the atmosphere to raise the carbon potential of the furnace atmosphere. In most industrial processes, the endo gas is produced using an external generator. However, Barbour U.S. Pat. No. 6,159,306 discloses a device for the internal or in-situ generation of endo gas within the confines of the furnace cavity. The in-situ generator device as shown in the '306 patent is marketed by the Heavy Carbon Co. of Pittsford, Mich. under the trademark ENDOCARB™.

During operation of a furnace, using either an internal or an external generator, the carbon potential of the furnace atmosphere can become too high. When the carbon potential becomes too high it can lead to the excessive formation of carbon on the metal parts being carburized, which can cause the parts to "cement" together, and also the formation of excess carbon in the interior of the furnace ("soot"). In order to lower the carbon potential of a furnace atmosphere, it is a common practice to add air to the process chamber of the furnace. However, when the carbon potential is lowered, the time required to carburize is increased. Thus, it would be very desirable to be able to operate a furnace at a very high carbon potential and avoid the complications of excessive carbon formation or sooting.

Naito et al. U.S. Pat. No. 6,051,078 discloses a method of carburization wherein endo gas is generated inside the furnace. However, like many prior art methods, such method leads to uncontrolled sooting when the carbon potential is in excess of about 1.3%.

BRIEF SUMMARY OF THE INVENTION

The present invention provides a new and improved method of heat treating that allows the furnace atmosphere to be maintained at a very high carbon potential (over 1.4%) in the absence of uncontrolled sooting, thereby resulting in shorter furnace cycle times.

The present invention provides a new and improved method of carburizing ferrous metal parts which affords many distinct advantages over prior art methods. Specifically, the method of the present invention provides shorter carburizing cycles, improved control of carbon potential and avoids carbon sooting of furnace interiors, and the clogging and cementing together of the parts that are being carburized. Additionally, the method of the present invention allows one to carburize ferrous metal parts without having to generate or provide an external source of carrier gas. In applications where it is desired, the method can be used to produce carburized parts with sharper carburized to non-carburized zones, which can lead to parts showing greater ductility and/or toughness.

The method of the present invention includes the use of multiple boosting and cleaning steps. More particularly, the method comprises the steps of providing a furnace for heating the metal parts and a process chamber, purging the air atmosphere from the process chamber and heating the process chamber to a temperature of at least 1100° F., feeding a gas and a source of air to the process chamber, preferably both at a constant flow rate, boosting the process chamber by feeding an enriching gas to the process chamber to create a carbon potential of at least 0.5%, cleaning the process chamber by decreasing the flow of enriching gas to the process chamber to create a carbon potential of less than about 0.25%, repeating the boosting step after performing the cleaning step; and repeating the cleaning step after performing the second boosting step.

This method allows for operation of the furnace at a carbon potential in excess of 1.4% during the majority of the boosting steps without the formation of undesirable levels of soot within the process chamber. This leads to quicker carburization and shorter furnace cycle times. It will be appreciated that the method of the present invention may also be used in connection with furnaces that are capable of serving as their own in-situ generator, and thus without the need for a separate generator.

The foregoing and other features of the invention are hereinafter more fully described and particularly pointed out in the claims below. The following description sets forth in detail certain illustrative embodiments of the invention, these being indicative, however, of but a few of the various ways in which the principles of the invention may be employed.

DETAILED DESCRIPTION OF THE INVENTION

Figure 1:
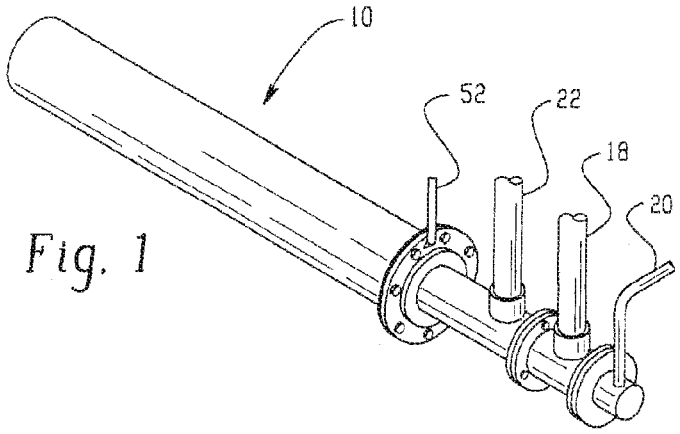
FIG. 1 is a perspective view of a portion of a generator device suitable for use in the method of the present invention.

The principles of the present invention may be practiced in conjunction with various furnaces and with various types of fuel and enriching gases. Additionally, the method of the present invention is not limited to carburizing processes that employ a generator (either external or in-situ generators, or in-situ generators that are either partially or substantially isolated from the process chamber).

The furnaces with which the present invention may be employed include batch-type furnaces (box furnaces), rotary furnaces, rotary retort furnaces, continuous furnaces (pusher-type) and pit furnaces. These furnaces generally have heating and cooling means, one or more process chambers in which the workpieces are placed on a hearth or platform, or suspended, and exposed to heat and carburizing atmosphere, and one or more doors or accesses through which the steel parts pass into or out of the chamber. In addition to the foregoing, there are usually vents to direct the flow of furnace gases, vestibules between the doors to the chamber and the outer doors to the furnace, and circulating fans to expedite gas phase mass transfer and heat transfer.

The pusher-type (continuous) furnace differs from the other furnaces only in that it has a series of chambers and doors through which the steel parts are pushed from one end of the furnace to the other. Another important difference between batch furnaces and continuous furnaces is that in batch furnaces, carburizing does not begin until the furnace reaches the carburizing temperature, which is typically about 30 minutes after the doors are closed, and there is no door opening until the end of the carburization cycle. On the other hand, in the continuous furnaces, doors are opened and closed frequently, typically about every hour.

The carburizing chambers or process chambers of the furnaces are "closed," which means that vents or any other openings through which gases can pass into or out of the chamber are generally closed throughout the process except, of course, for the passages, door or other openings, through which the steel parts pass into or out of the chamber; gas inlet ports necessary to provide the carburizing atmosphere, venting for purposes of controlling furnace pressure and gas flow and sample ports commonly used for testing purposes. The objective of the "closed" chamber is to keep the influx of oxidizing gases to a minimum and limit losses of carburizing atmosphere. When practicing the present invention, preferably, the process chamber is kept "closed" as much as possible to prevent the uncontrolled outflow of furnace atmosphere and the uncontrolled influx of air.

Door opening and closing and the introduction of the steel workpieces or load may be accomplished manually or automatically, but is, again, conventional as is the internal temperature of the process chamber where the carburizing takes place. This temperature lies within a range of about 1100° F. to about 2200° F., and is generally about 1500° F. to about 1850° F., and most preferably about 1800° F.

Total carburizing cycle time is about 0.5 to about 50 hours and is typically about 3 to about 9 hours. Particular times, however, are selected according to the desired effective case depth, the composition of the parts being carburized, the desired carbon content and enriching gases being utilized.

Various gases and atmospheres can be used in the method of the present invention. The gases that can be used in connection with the present invention include the gases discussed in U.S. Pat. Nos. 4,049,472 and 4,306,918, the disclosures of which are incorporated herein by reference. The enriching gas employed in the method of the present invention is generally a gas selected from the group consisting of $CH_4$, CO, $C_2H_6$, $C_2H_4$, $C_6H_6$, $C_4H_4$, $C_3H_8$ and mixtures of such gases. A preferred enriching gas is methane ($CH_4$) because of its cost and availability.

Generally, the method of the present invention includes the use of multiple boosting and cleaning steps. More particularly, the method comprises the steps of providing a furnace for heating the metal parts and a process chamber, purging the air atmosphere from the process chamber and heating the process chamber to a temperature of at least 1100° F., supplying a constant flow of air and gas to the process chamber, boosting the process chamber by feeding an enriching gas to the process chamber to create a carbon potential of at least 0.5%; cleaning the process chamber by decreasing the flow of enriching gas to the process chamber to create a carbon potential of less than about 0.25%, repeating the boosting step after performing the cleaning step; and repeating the cleaning step after performing the second boosting step. In a preferred method, the constant flow of gas is a fuel gas which is partially combusted with a portion of the air and fed to the process chamber.

The process chamber may be purged using conventional techniques such as by the introduction of a carrier gas or an inert gas such as nitrogen to the process chamber.

The fuel gas employed in the method of the present invention is generally a gas selected from the group consisting of $CH_4$, CO, $C_2H_6$, $C_2H_4$, $C_6H_6$, $C_4H_4$, $C_3H_8$ and mixtures of such gases. A preferred fuel gas is methane ($CH_4$) because of its cost and availability.

During the boosting and cleaning steps it is important to maintain a substantially constant total flow of air to the process chamber. Total flow of air means the total amount of air that is consumed in the production of the furnace atmosphere. During the boosting steps the enriching gas is supplied to the process chamber at a ratio of from about 0 to about 1.2 cubic feet of enriching gas to every cubic foot of air. During the cleaning steps the amount of enriching gas is reduced, and thus generally during the cleaning steps the enriching gas is supplied to the process chamber at a ratio of from about 0.0 to about 0.35 cubic feet of enriching gas to every cubic foot of air. It will be appreciated that it may be possible to create a carrier gas in the process chamber during the boosting and cleaning steps, but the use of a carrier gas formed by a generator is not required. It may be possible to form the carrier gas within the process chamber without the use of a generator.

In addition to keeping the total air flow constant, it is preferred the amount of fuel gas used in the method is also kept constant during the boost and cleaning steps.

The flow rates of air, fuel gas and enriching gas in the method of the present invention may be represented by the equation $X=Y+Z$ wherein during the boosting step and the cleaning step the total air flow comprises a flow rate of X cubic feet per hour, and during the boosting step the enriching gas flow comprises a maximum flow rate of Y cubic feet per hour, and during said cleaning step the fuel gas flow comprises Z cubic feet per hour, such that the flow rates of the Y plus Z equals approximately the total air flow rate X (±5%). Total air flow means the constant flow of air comprising the air/gas mix fed into the process chamber. Preferably both the total air flow rate X and the fuel gas flow rate are held constant during all boost and cleaning steps. Preferably, the only gas flow rate that is altered is the enriching gas flow rate, such rate being varied from zero flow to a set maximum flow such that the preceding equation $X=Y+Z$ is satisfied. For example, if a total air flow rate of 90 CFH (cubic feet per hour) is utilized along with a fuel gas flow rate of 23 CFH, then the maximum flow rate of enriching gas utilized should be 67 CFH. All references to CFH herein, and in the claims below, is measured at substantially ambient temperatures and pressures.

In situations where the same gas is used as both a fuel gas and also an enriching gas to boost the furnace, Z would represent a minimum flow rate of hydrocarbon gas that is required to form a neutral or slightly carburizing atmosphere in the process chamber and Y would represent an additional amount of such hydrocarbon gas to boost the furnace. Thus, in the situation where methane is used both as a fuel gas and as an enriching gas, if the total air flow to the process chamber is 90 CFH and the minimum flow rate of methane to form the carrier gas is 23 CFH, then the maximum amount of additional methane gas (enriching gas) that should be provided to the process chamber is about 67 CFH of methane.

The carbon potential is preferably controlled by an instrument that controls the gas enriching flow by turning a solenoid on and off. This flow should be in a controlled range so when more enriching gas is called for, the flow will not be in excess. In accordance with the method of the invention, the desired maximum gas flow will be close to the same flow as the air flow, but it is not necessarily constant as is the air flow. The instrument will only add enough gas to reach the carbon potential. Preferably, there is another mix of air and gas that is not controlled by an instrument. This mixture is preset (e.g., at a 4 to one ratio of air to gas). When more gas is needed to raise the carbon potential, the instrument will add only gas to this mix. The air flow is not changed. This is very much different than conventional carburizing methods. This means that the method typically requires the use of three flow scopes: one air; and two gas.

Various cycle times can be used depending upon such factors as the maximum carbon potential being run, or the configuration and size of the furnace, the integrity of the furnace seal, the final carbon level desired in the part, the chemistry of the load being processed, desired depth of carburization, etc. However, generally, the boosting steps are performed for a period of from about 10 to about 90 minutes, and the cleaning steps are performed for a period of from about 3 to about 40 minutes.

It will be appreciated that it although the preferred carrier gas for use in the present invention is an endothermic gas which is formed by partial combustion of a fuel gas/air mixture, other carrier gases may be used (e.g., for purging and/or for carrying the enriching gas(es)). For example, another potential carrier gas is a prepared nitrogen base atmosphere which is an exothermic base with carbon dioxide and water vapor removed. Another potential carrier gas is a charcoal based atmosphere which is formed by passing air through a bed of incandescent charcoal. Another potential carrier gas is an exothermic-endothermic base atmosphere formed by partial combustion of a mixture of fuel gas and air, removing the water vapor, and reforming the carbon dioxide to carbon monoxide by means of a reaction with fuel gas in an externally heated catalyst filled chamber. Another potential carrier gas is an ammonia base atmosphere which can be formed by raw ammonia, dissociated ammonia, a partially or completely combusted dissociated ammonia with a regulated dew point. The carrier gas may also be of a type which is formed in-situ by the decomposition of a hydrocarbon liquid at elevated temperatures. These above gases and others which provide a carburizing atmosphere in a furnace are generically referred to in this specification and the claims below as a "carrier gas." As used in this specification and the claims below the term "carrier gas" means a gas media which in and of itself is capable of providing a neutral or positive carbon potential atmosphere within the process chamber of a furnace.

In order to impart carbon into the ferrous metal parts which are to be carburized, the furnace atmosphere contained within the process chamber must have a carbon potential. Carbon potential is a measure of the ability of a carburizing gas to increase the carbon level of the ferrous metal parts. The carbon potential will depend on such factors as the temperature of the furnace atmosphere, the dew point of the furnace atmosphere, and the amount of carbon (C) contained in the furnace atmosphere. As the dew point goes down, the carbon potential increases. For purposes of this specification and the claims below "carbon potential" is defined as the weight percent carbon dissolved on a steel surface which is in equilibrium with the furnace atmosphere. The actual carbon potential of a furnace may be measured using various conventional means such as, for example, infrared analyzers and dew point analysis using various conventional means such as a dew cup instrument, a fog chamber, a chilled-mirror apparatus or a chilled-metal apparatus.

The carbon potential of the furnace atmosphere is attained and maintained by using an enriching gas. Increasing the ratio of the enriching gas to air contained in the process chamber generally leads to an increase in the carbon potential.

Figure 5:
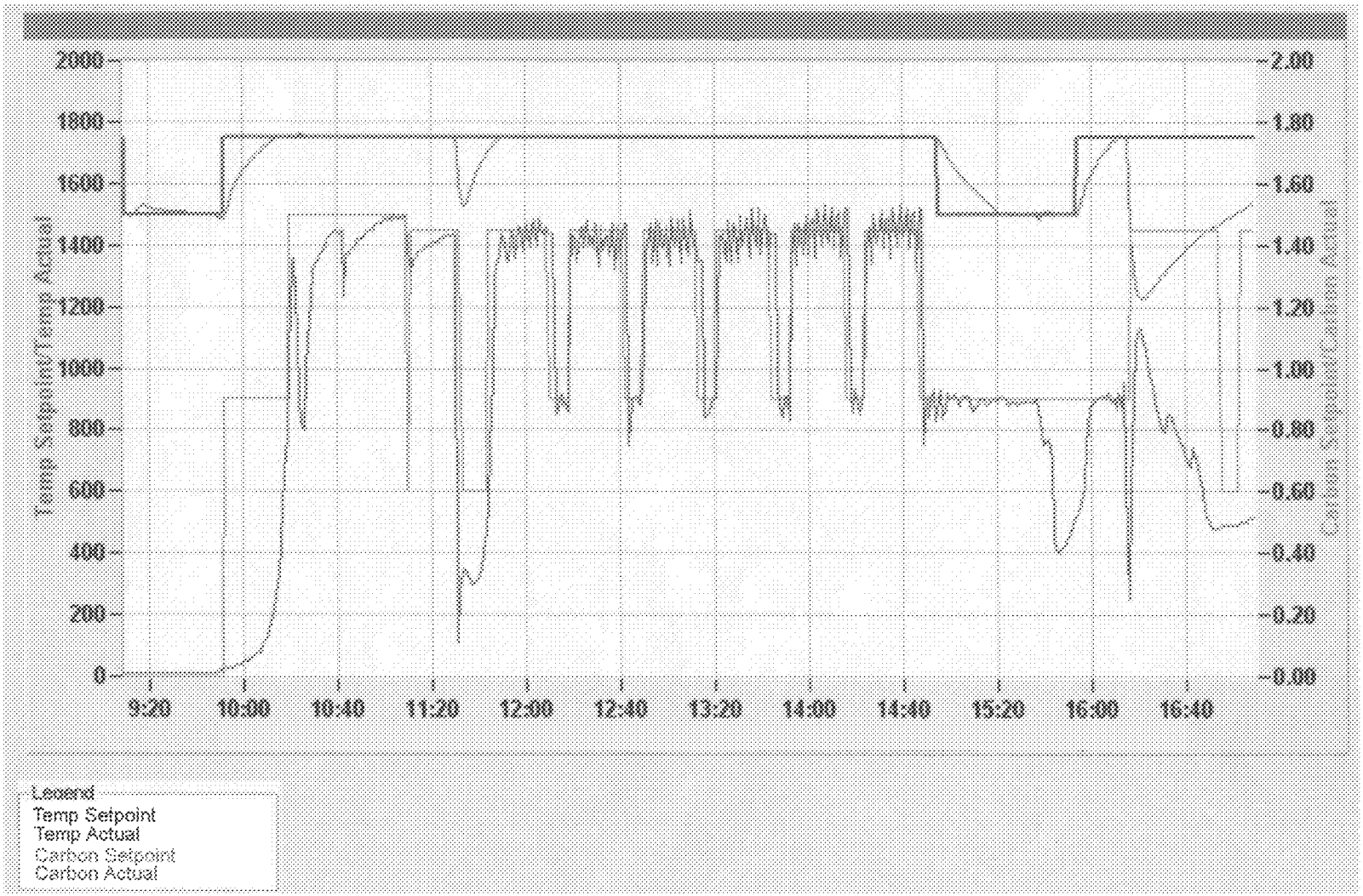
FIG. 5 is a graph showing both temperature (setpoint and actual) and carbon potential (setpoint and actual) as a function of time during an exemplary three hour carborization operation in accordance with the method of the invention.

One of the main benefits of the present invention is the ability to attain and hold carbon potentials in excess of 1.4%, and preferably in excess of 1.5%, without the development of undesirable sooting of the furnace. By being able to attain such high carbon potentials without undesirable sooting, furnace cycle times can be greatly reduced. Also, by running multiple boost and clean cycles, the furnace is kept relatively soot-free, and carburization rates are much higher in a clean furnace as compared to a sooted furnace. The atmosphere in the furnace is more active and functional when the furnace is clean. FIG. 5 is a graph that shows both temperature (setpoint and actual) and carbon potential (setpoint and actual) as a function of time during an exemplary three hour carborization operation. The graph shows how soot is controlled. Without the short cleaning time provided for each cycle, the soot will build up and lead to detrimental conditions within the furnace. As shown in the graph, with soot controlled, carbon potential can be maintained relatively steady at 1.45% during the carburization cycle.

Although the method of the present invention may be practiced using various in-situ generator devices, a preferred device is a modified version of the ENDOCARB™ device disclosed in U.S. Pat. No. 6,159,306 the disclosure of which in incorporated herein by reference. Applicant believes that the teachings of the present invention may also be employed in connection with conventional closed furnaces (e.g., a closed rotary retort or box furnaces) that utilize a carrier gas and that are capable of serving as their own in-situ carburizer upon being fed a mixture of air and fuel gas, with or without the need of a separate generator device. Such method is disclosed in part in U.S. Pat. No. 5,827,375, the disclosure of which is incorporated herein by reference. Thus, the process chamber could be located within the furnace itself, or it could be within a device such as the ENDOCARB™ device that is operatively associated with the furnace and supplies the atmosphere for carburizing the metal parts to the furnace.

Figure 2:
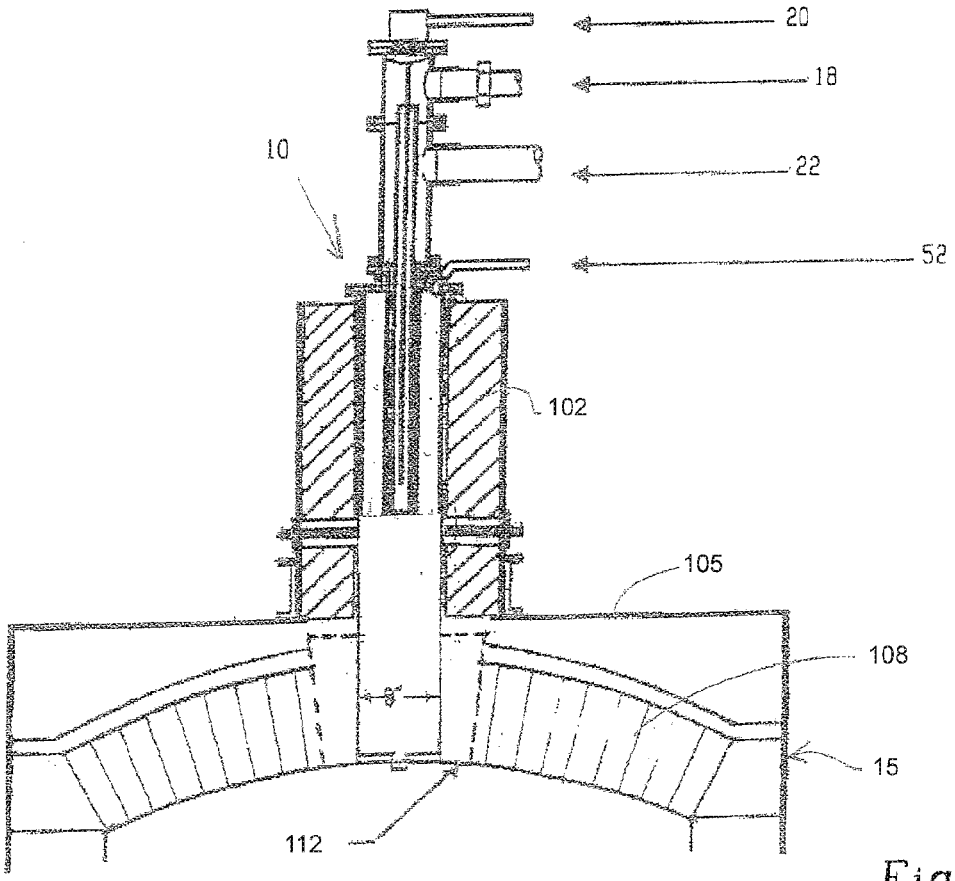
FIG. 2 is a schematic broken-away view of the generator device of FIG. 1 mounted on a furnace.

Referring now to the drawings, and initially to FIGS. 1 and 2 there is illustrated a carburizing or generator device 10 that can be used with the method of the present invention. Device 10 facilitates the production of a carburizing furnace atmosphere by merely using a source of air and fuel and enriching gas. Device 10 is adapted to be mounted on a furnace 15 as partially illustrated in FIG. 2. Device 10 includes an inlet 18 for air and an inlet 20 for hydrocarbon fuel at its fore-end, and an exhaust outlet 22 for exhausting the combusted air and fuel. Also provided near the fore-end of the device 10 is an inlet 52 for the air and fuel gas that is to be partially combusted by the device 10 to produce a carburizing atmosphere in the furnace 15. Located at the distal end of the device 10 is an outlet for the partially combusted fuel gas which is fed into the process chamber of the furnace 15.

Figure 3:
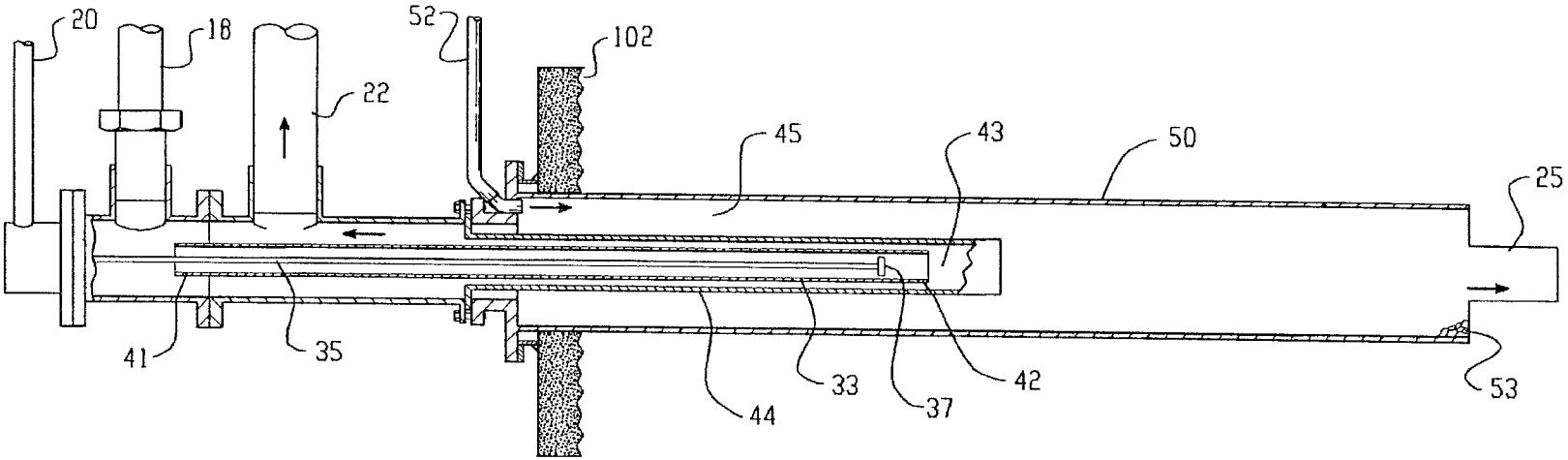
FIG. 3 is a partially cross-sectioned and broken away schematic view of the generator device of FIGS. 1 and 2.
Figure 4:
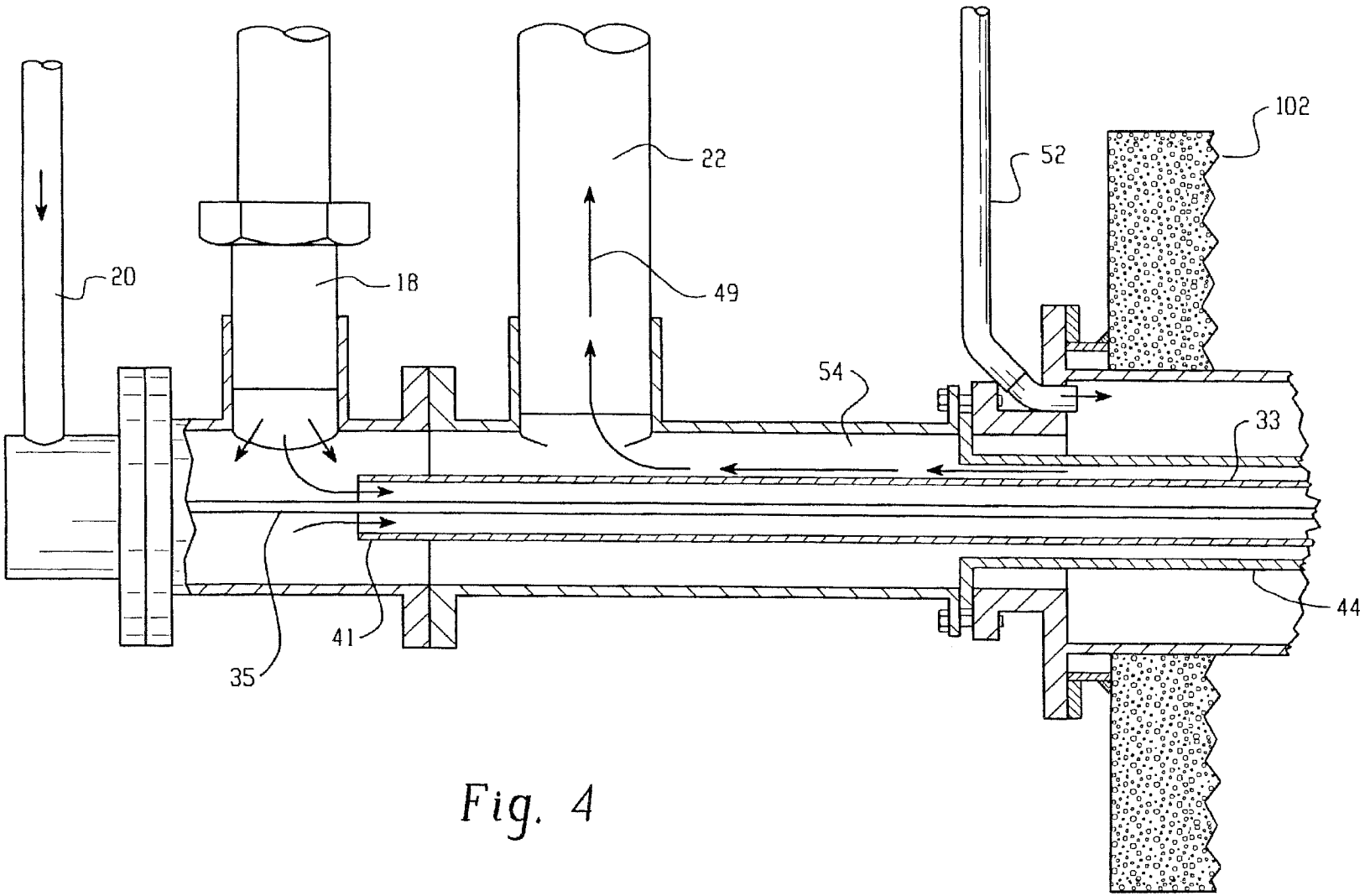
FIG. 4 is an enlarged view of a portion of FIG. 3.

Referring now to FIGS. 3 and 4 additional internal details of the device 10 are clearly illustrated. Specifically, device 10 includes a combustion tube 33 into which the fuel from inlet 20 is fed via tube 35. Provided at the end of tube 35 is a diffuser 37 having numerous openings that help to mix the air with the fuel within combustion tube 33. Air is fed into the combustion tube 33 via inlet 18. A conventional spark plug device (not shown) is included within the combustion tube 33 in order to ensure proper ignition and combustion of the gas and air that is supplied. Combustion tube 33 which is open at its fore end 41 is also open at its distal end 42, and thus the products of combustion flow into outer radiant heater tube 44 and are exhausted via stack 22. Radiant heater tube 44 forms a cavity 43 around a portion of combustion tube 33, which is in communication with stack 22 by means of a space 54 between tube 33 and an outer portion of the upper end of the device 10. Cavity 43 facilitates the flow of gases formed in combustion tube 33 from tube 33 and into stack 22. Any one of a variety of hydrocarbon fuels may be used in the present invention. Examples of such fuels include, but are not limited to methane, propane, benzene vapors, ethane, petroleum distillates and mixtures thereof.

Surrounding a major portion of the radiant heater tube 44 is the generator tube 50. Generator tube 50 is located in the immediate proximity of the tube 44 and it forms a cavity 45. A mixture of air, fuel and enriching gas is fed into generator tube 50 by inlet tube 52. The cavity 45 formed by generator tube 50 may be filled at least half full with a catalyst 53 (partially shown) to promote the cracking or partial combustion of the air/enriching gas mix that is fed into tube 50. A suitable metal catalyst for use with the present invention is electrolytic nickel/nickel catalyst. It will be appreciated that any one of a variety of conventional metal catalysts may be employed. Alternatively, the tubes 50 and 44 may be constructed of a 600 Alloy steel that contains a high level of chrome and nickel thereby rendering the tubes 50 and 44 self-catalytic. The partially combusted gas formed in generator tube 50 leaves the tube via outlet 25 and is fed into the process chamber of the furnace. Heat formed by combustion in combustion tube 33 flows through radiant heater tube 44 and into the generator tube 50. This heat in combination with the catalyst serves to facilitate the cracking or partial combustion of the enriching gas that is fed into generator tube 50. In FIGS. 3 and 4 various arrows 49 are included to help illustrate the flow of the various gases in device 10.

Preferably, air and fuel are fed within combustion tube 33 at such a rate as to maintain the radiant heater tube 44 at a temperature of about 1500° F. to about 2000° F. in order to ensure proper cracking of the enriching gas.

With the proper mixture of air and enriching gas flowing or being fed into the generator tube 50, and with the combustion tube being maintained at a temperature of from about 1500° F. to about 2000° F., a carburizing atmosphere is formed in the process chamber. This allows the furnace to operate at a carbon potential in excess of 1.4% (preferably in excess of 1.5%) during the majority of the carburizing step without the formation of soot.

Referring now to FIG. 2, the generator device 10 is mounted on a furnace. As shown in the drawing, device 10 is mounted in the top 105 of the furnace 15 through the arch 108. Insulation 102 (insulation is shown in full in FIG. 2, but is only partially shown in FIGS. 3 and 4, and is not shown at all in FIG. 1) and ceramic bung 112 are provided around the tube 50 in order to maintain the heat within the tube 50. It will be appreciated that the generator device can be mounted to the furnace in different ways, including but less preferably, partially or wholly within the chamber of the furnace.

The process is capable of being used to carburize any type of ferrous metal that is currently being carburized using conventional carburizing techniques. The process of the present invention is in no way limited to any particular class or grade of steel or ferrous alloy.

As noted above, conventional carburizing processes and devices require the use of a carrier gas to produce the proper atmosphere within the furnace. An endothermic atmosphere generator is used to create an atmosphere, which is commonly referred to as endogas. Endogas is used to fill an atmosphere furnace and it is also used as a carrier gas. To create endogas, an air/gas mixture is entered into a retort and heated to a high temperature. In the presence of a nickel catalyst a reaction takes place that cracks this air/gas mixture into an atmosphere made up of about 38% hydrogen, 40% nitrogen, and 20% carbon monoxide and other gases in small amounts. The dew point is controlled usually between about 35° F. and 40° F. The atmosphere is then cooled and piped to an atmosphere furnace.

However, in accordance with the method and device according to the invention, there is no need for such a carrier gas. The carrier gas is replaced by an air/gas mixture that is entered into a self heated retort. The retort is constructed of a high nickel content which becomes the catalyst. There is never a need to replace the catalyst as in an endogas generator because the retort is the catalyst. The retort is located on top of the furnace in its own insulated shell welded gas tight to the furnace. The air/gas mixture entered into this retort is heated to the temperature required to create a carburizing atmosphere (e.g., 1800° F.), and thus enters the furnace hot. Unlike an endo generator, the dew point is not a factor for this atmosphere because it is controlled by the furnace carbon potential (CP). And air need not be added to the furnace for CP control. The only air that is used is in the retort for the reaction. The volume of air that enters the retort is preferably constant, with no variation. The volume of hydrocarbon gas flow into the retort will vary in the amount necessary to produce the proper carbon potential in the furnace. The amount of carbon in the atmosphere will determine the carbon potential. With a flow of hydrocarbon gas that is too high, the atmosphere becomes too rich and soot will form. If the flow is too low, the atmosphere becomes too lean and decarb will take place. For a perfect carburizing atmosphere using the method of the invention, there is a constant variation (i.e., cycling) of a high flow and a low flow of hydrocarbon gas into the endocarb retort. In this manner there is a gas savings because there is never an excess flow of an enriching gas. This control is selected (i.e., programmed) to meet the requirements of the load that is being carburized.

The program will consist of dividing the amount of carburizing time required into cycles, which are preferably thirty minutes in length. For example, a carburizing time of sixteen hours instead of the 22 hours as required by the Harris equation to reach an effective case depth of 0.105, will require 32, thirty-minute cycles. Preferably, each cycle will have a boost time of about 20 minutes at a CP of 1.5% C and a diffuse time of about 10 minutes at a CP of 0.90% C. The high CP will increase the rate of carbon penetration into the steel surface while the lower CP will clean the furnace and maintain a strong reaction. If the boost time is too long, soot will form and slow down the process. If the diffuse time is too long, there will be no soot, but the gain will be compromised. This becomes a balance of just the right amount of boost and diffuse time. This balance becomes clear very quickly and never needs changing once established. It will remain the same for any number of cycles (e.g., half hour cycles) and different loads as well as load sizes. With this type of carbon control, it is not necessary to lower the furnace temperature because the furnace will not overheat.

Figure 6:
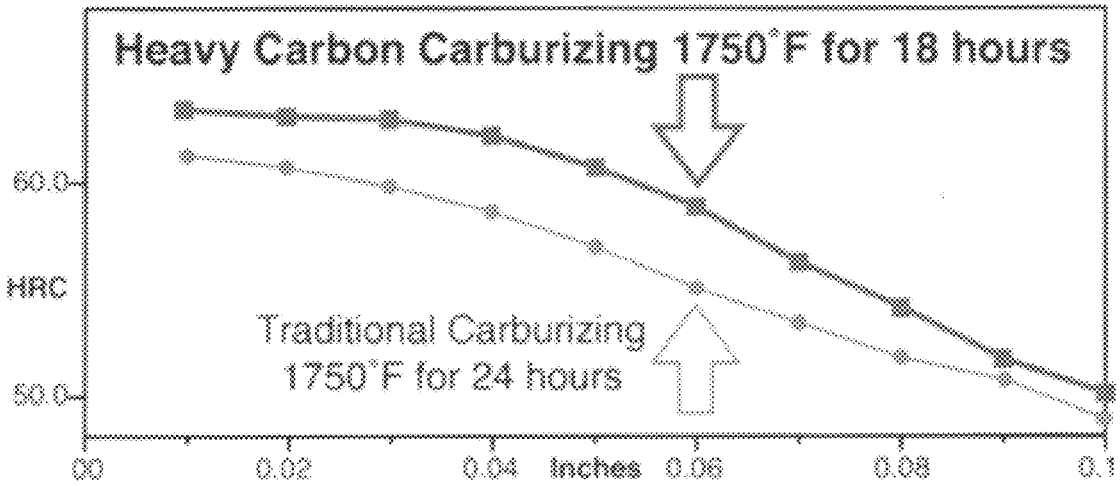
FIG. 6 is a graph showing Rockwell Hardness as a function of depth for a conventional carburization process conducted for twenty four hours as compared to a carburization process according to the invention conducted for 18 hours at the same temperature.

Use of the method of the invention yields only positive results with a faster carb cycle using less gas while controlling the soot for a clean furnace. For example, FIG. 6 is a graph showing Rockwell Hardness as a function of depth for a conventional carburization process conducted for twenty four hours as compared to a carburization process according to the invention conducted for 18 hours at the same temperature. A higher Rockwell Hardness as a function of depth in less time using the method of the invention. This translates into substantial cost savings in terms of process gas and operating time.

By way of illustration and not by any limitation, the following Example will describe a method of carburizing ferrous metal parts within the scope of the present invention.

Illustrative Example 1

The furnace comprises a batch-type Surface Combustion All-Case internal quench furnace. Such furnace includes a main heating zone having a volume of about 150 cubic feet and a modified ENDOCARB™ generator or carburizing device as described above and shown in FIG. 2.

The furnace cavity was heated to a temperature of about 1750° F. and about 1400 pounds of high alloy 8620 steel parts were charged into the furnace and the furnace was purged of atmospheric air by using a carrier gas formed by the ENOCARB™ generator. The furnace temperature dropped to about 1300° F. after loading. It took about 2 hours for the furnace to recover to 1750° F. wherein the furnace was held at temperature for 21 minutes during a boost carburizing phase. During this boost step 90 cubic feet per hour (CFH) of air was supplied to the generator along with a minimum of 23 CFH of methane (serving as the fuel gas), and additional intermittent maximum flows of methane (serving as enriching gas) up to 67 CFH. A carbon potential of about 1.45% was achieved for most of the boost and the boost phase lasted about 21 minutes. The furnace was then taken into a cleaning phase for about 7 minutes by maintaining an air flow of 90 CFH and a methane fuel gas flow of 23 CFH (no additional enriching methane gas was added) until a carbon potential of 0.9% was attained. Once the 0.9% carbon potential was attained, a small amount of enriching methane gas was added in order to maintain the 0.9% carbon potential. The boost and clean steps were then repeated 6 times.

After the last cleaning step the load was then quenched. The parts displayed an effective case depth of about 0.45 inches. No unwanted carbides were found in the parts. The cycle saved about 1 hour of carburization time as compared to a conventional heat treat cycle, and the furnace was clean at the end of the process.

The foregoing process was run with a total of 10 boost and clean steps, and an effective case depth of 0.59 inches was attained at a savings of about 2 hours compared to conventional processing. The foregoing process was also run with a total of 32 boost and clean steps, and an effective case depth of 0.105 inches was attained at a savings of about 6 hours compared to conventional processing.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

What is claimed is:

1. A method of carburizing ferrous metal parts comprising the steps of:

(a) providing a furnace for heating the metal parts and a process chamber;

(b) purging an air atmosphere from the process chamber and heating said process chamber to a temperature of at least 1100° F.;

(c) feeding a fuel gas to the process chamber and a source of air at a constant flow rate to the process chamber;

(d) boosting the process chamber by feeding an enriching gas to the process chamber to create a carbon potential of at least 0.5%;

(e) cleaning the process chamber by decreasing the flow of enriching gas to the process chamber to create a carbon potential of less than about 0.25%;

(f) repeating the boosting step (d) after performing said cleaning step (e); and (g) repeating the cleaning step(e) after performing said repeated boosting step (f).

2. The method according to claim 1, wherein during said boosting step (d) the enriching gas is supplied to the process chamber in an amount up to about 1.2 cubic feet of enriching gas per cubic foot of air.

3. The method according to claim 1, wherein during said cleaning step (e) the enriching gas is supplied to the process chamber in an amount up to about 0.35 cubic feet of enriching gas per cubic foot of air.

4. The method according to claim 1, wherein said boosting step (d) is performed for a period of from about 10 to about 90 minutes.

5. The method according to claim 1, wherein said cleaning step (e) is performed for a period of from about 3 to about 40 minutes.

6. The method according to claim 1, wherein during said boosting step (d) the process chamber is maintained at a temperature of from about 1,500° F. to about 1,850° F.

7. The method according to claim 1, wherein said gas of said step (b) is at least one gas selected from the group consisting of a carrier gas, $CH_4$, CO, $C_2H_6$, $C_2H_4$, $C_6H_6$, $C_4H_{10}$, $C_3H_8$ and mixtures thereof.

8. The method according to claim 1, wherein said enriching gas is at least one gas selected from the group consisting of $CH_4$, CO, $C_2H_6$, $C_2H_4$, $C_6H_6$, $C_4H_{10}$, $C_3H_8$ and mixtures thereof.

9. The method according to claim 1, wherein said furnace comprises a furnace selected from the group consisting of a rotary furnace, a rotary retort furnace, a continuous furnace and a batch furnace.

10. The method according to claim 1, wherein during said boosting step (d) a carbon potential of at least 1.4% is attained in the process chamber.

11. The method according to claim 1, wherein during said boosting steps (d) and (f) and said cleaning steps (e) and (g) a constant total air flow rate is maintained.

12. The method according to claim 1, wherein during said purging step (b) the process chamber is purged using a carrier gas.

13. The method according to claim 12, wherein said carrier gas comprises an endothermic carrier gas formed by the partial reaction of the fuel gas and a portion of the air in an externally heated catalyst filled chamber.

14. The method according to claim 13, wherein said externally heated catalyst filled chamber comprises an endothermic gas generator.

15. The method according to claim 1, wherein during said purging step (b) the process chamber is purged using an inert gas.

16. The method according to claim 15, wherein said inert gas comprises nitrogen.

17. The method according to claim 1, wherein said gas of said step (b) comprises a carrier gas formed by the partial combustion of a fuel gas.

18. The method according to claim 17, wherein during said boosting step (d) and said cleaning step (e) said total air flow comprises a flow rate of X cubic feet per hour, and during said boosting step (d) the maximum enriching gas flow comprises a flow rate of Y cubic feet per hour, and during said boosting step (d) and said cleaning step (e) the fuel gas flow rate used to form the carrier gas comprises a flow rate of Z cubic feet per hour, such that the flow rates of the Y plus Z equals approximately the total air flow rate X.

19. The method according to claim 17, wherein during said steps (d), (e), (f) and (g) said total air flow rate and said fuel gas flow rate is constant.

20. The method according to claim 17, wherein said carrier gas is produced externally of the process chamber.

21. The method according to claim 17, wherein said furnace includes a generator device comprising a combustion tube and a radiant heater tube for combusting a source of hydrocarbon fuel and generating a source of heat, a generator tube surrounding at least a portion of said radiant heater tube, said generator tube having an inlet for receiving the air and the fuel gas, and an outlet tube for exhausting partially com busted fuel gas to the process chamber.

22. The method according to claim 21, wherein said generator tube is at least partially isolated from said process chamber.

23. The method according to claim 21, wherein said generator device is mounted such that a substantial portion of the generator tube is not located in the process chamber of the furnace.

24. The method according to claim 21, wherein said enriching gas is inlet for receiving fuel gas and the air.

25. The method according to claim 17, wherein said enriching gas and said fuel gas both comprise methane ($CH_4$).

26. A method of heat treating ferrous metal parts comprising the steps of:

(a) providing a furnace for heating the metal parts and a process chamber;

(b) purging an air atmosphere from the process chamber and heating said process chamber to a temperature of at least 1100° F.;

(c) feeding a fuel gas to the process chamber and a source of air;

(d) boosting the process chamber by feeding an enriching gas to the process chamber to create a carbon potential of at least 0.5%;

(e) cleaning the process chamber by decreasing the flow of enriching gas to the process chamber to create a carbon potential of less than about 0.25%;

(f) repeating the boosting step (d) after performing said cleaning step (e);

(g) repeating the cleaning step(e) after performing said repeated boosting step (f);

(h) wherein during said cleaning and boosting steps said fuel gas and said air is fed to the process chamber at a constant flow rate.

27. The method according to claim 26, wherein said fuel gas is partially consumed to form an endothermic carrier gas.

* * * * *